United States Patent [19]

Tanjo et al.

[11] Patent Number: 5,026,043

[45] Date of Patent: Jun. 25, 1991

[54] OVERLAPPED-TRANSFER PREVENTING PAPER SUPPLY DEVICE IN IMAGE FORMING APPARATUS

[75] Inventors: Toru Tanjo, Toyonaka; Noboru Fukuoka, Ozu, both of Japan

[73] Assignee: Mita Industrial Co., Ltd., Osaka, Japan

[21] Appl. No.: 441,320

[22] Filed: Nov. 27, 1989

[30] Foreign Application Priority Data

Nov. 28, 1988 [JP] Japan ..... 63-301407

[51] Int. Cl.[5] ..... B65H 3/52

[52] U.S. Cl. ..... 271/121; 271/122

[58] Field of Search ..... 271/121, 122, 124, 125, 271/137, 138, 104

[56] References Cited

U.S. PATENT DOCUMENTS 3,861,670 1/1975 Kraft ..... 271/125 X
4,709,911 12/1987 Saiki et al. ..... 271/122 X
4,779,861 10/1988 Ozawa et al. ..... 271/122 X
4,852,868 8/1989 Fukui et al. ..... 271/122

FOREIGN PATENT DOCUMENTS 36246 2/1987 Japan ..... 271/125

*Primary Examiner*—David H. Bollinger
*Attorney, Agent, or Firm*—Wenderoth, Lind & Ponack

[57] ABSTRACT

An overlapped-transfer preventing paper supply device in an image-forming apparatus includes an overlapped-transfer preventing member and a rotary paper supply member in an overlapped-transfer preventing portion. A sheet-returning member returns a sheet located in the vicinity of the overlapped-transfer preventing portion to a sheet source or supply and moves from a downstream side to an upstream side of the overlapped-transfer preventing portion. A drive operates in response to a sheet-returning signal to move the sheet-returning member in a sheet-returning direction. A sheet located in the vicinity of the overlapped-transfer preventing portion can be prevented from being damaged, and jamming due to such sheet can be prevented.

12 Claims, 4 Drawing Sheets

OVERLAPPED-TRANSFER PREVENTING PAPER SUPPLY DEVICE IN IMAGE FORMING APPARATUS

BACKGROUND OF THE INVENTION

1. Field of the Invention

The present invention relates to an overlapped-transfer preventing paper supply device for use in an image forming apparatus such as an electrophotographic copying machine and a printer.

2. Prior Art

For example, an electrophotographic copying machine includes a device for supplying a transfer portion with a non-copied sheets one-by-one each time a paper supply signal is generated, an intermediate paper supply device for enabling copying on both sides of a sheet for supplying a transfer portion with a sheet one side of which has been copied each time a paper resupply signal is generated, or a paper supply device for supplying an appointed position of a manuscript-table with a manuscript sheet each time a paper supply signal is generated.

Such paper supply devices include an overlapped-transfer preventing arrangement wherein an overlapped-transfer preventing member, such as a friction pad or a pad roller, is arranged so as to be engaged with a rotary paper supply member to prevent the double transfer of sheets by so-called frictional separation, or an overlapped-transfer preventing arrangement wherein a pad roller and rotary paper supply member are arranged so as to be partially overlapped such that a sheet passing between such members is caused to have a zigzag shape, thereby preventing double transfer of sheets by the firmness of the sheets.

However, in the above described overlapped-transfer preventing arrangement or devices, a sheet which has been subjected to an overlapped-transfer preventing operation moved is away from a sheet source or supply, such as a paper supply cassette or a paper supply deck. Thus, the leading end of such sheet is positioned in the vicinity of an overlapped-transfer preventing portion of a sheet transfer path that includes the overlapped-transfer preventing member and the rotary paper supply member that sometimes is positioned into the overlapped-transfer preventing portion.

Under such the condition, if the paper supply cassette then is removed or if a paper-placing plate of the paper supply deck is lowered, to enable the paper supply cassette, the paper supply deck, or the like to be provided with sheets, such sheet which has been subjected to the overlapped-transfer preventing operation remains in the paper supply portion. When subsequently the paper supply cassette, the paper supply deck or the like are replaced or set for further operation, not only will the sheet left in the paper supply portion be smashed to an extent to be useless but also jamming of following sheets will occur due to such damaged or smashed sheet.

SUMMARY OF THE INVENTION

A first object of the invention is to eliminate the above described disadvantages due to the location of the sheet at the overlapped-transfer preventing portion, and a second object of the invention is to eliminate an inconvenient situation brought about, contrary to expectations, by the achievement of the above described first object.

In order to achieve the above described objects, a first arrangement of the invention provides that a sheet-returning member, for returning a sheet located in the vicinity of an overlapped-transfer preventing portion of a sheet transfer path to a sheet source or supply, is provided to move from a downstream side to an upstream side of the overlapped-transfer preventing portion of the transfer path. Driving means, receiving a sheet-returning signal, moves the sheet-returning member in the sheet-returning direction. Such arrangement is included in an overlapped-transfer preventing device for use in a image forming apparatus, wherein the overlapped-transfer preventing device includes an overlapped-transfer preventing member and a rotary paper supply member.

A second arrangement of the invention additional provides that a sensor detects jamming in the vicinity of the overlapped-transfer preventing portion of the transfer path, and restraining means restrains the movement of the sheet-returning member in the sheet-returning direction when the sensor detects the presence of a jam.

When a sheet-returning signal is generated, the sheet-returning member is moved in the sheet-returning direction and a sheet located in the vicinity of the overlapped-transfer preventing portion is returned to the sheet source or supply.

The sheet-returning signal is generated in response to a signal indicating the completion of an image forming operation, a signal indicating supply of a sheet into the sheet source or supply, a signal indicating lowering of the sheet source or supply to enable supply of a sheet, and the like.

Jamming could occur in the vicinity of the overlapped-transfer preventing portion when the sheet is returned to the sheet source or supply by means of the sheet-returning member. If the sheet-returning operation is carried out in spite of the generation of such jamming, then the jammed sheet will be damaged by the sheet-returning member and will be useless. However, according to the second arrangement of the invention, when such jamming occurs in the vicinity of the overlapped-transfer preventing portion, the control for returning the above described sheet to the sheet source or supply is restrained thereby preventing the jammed sheet from being damaged.

DETAILED DESCRIPTION OF THE PREFERRED EMBODIMENTS

Preferred embodiments of the present invention will be described below with reference to the drawings.

Figure 2:
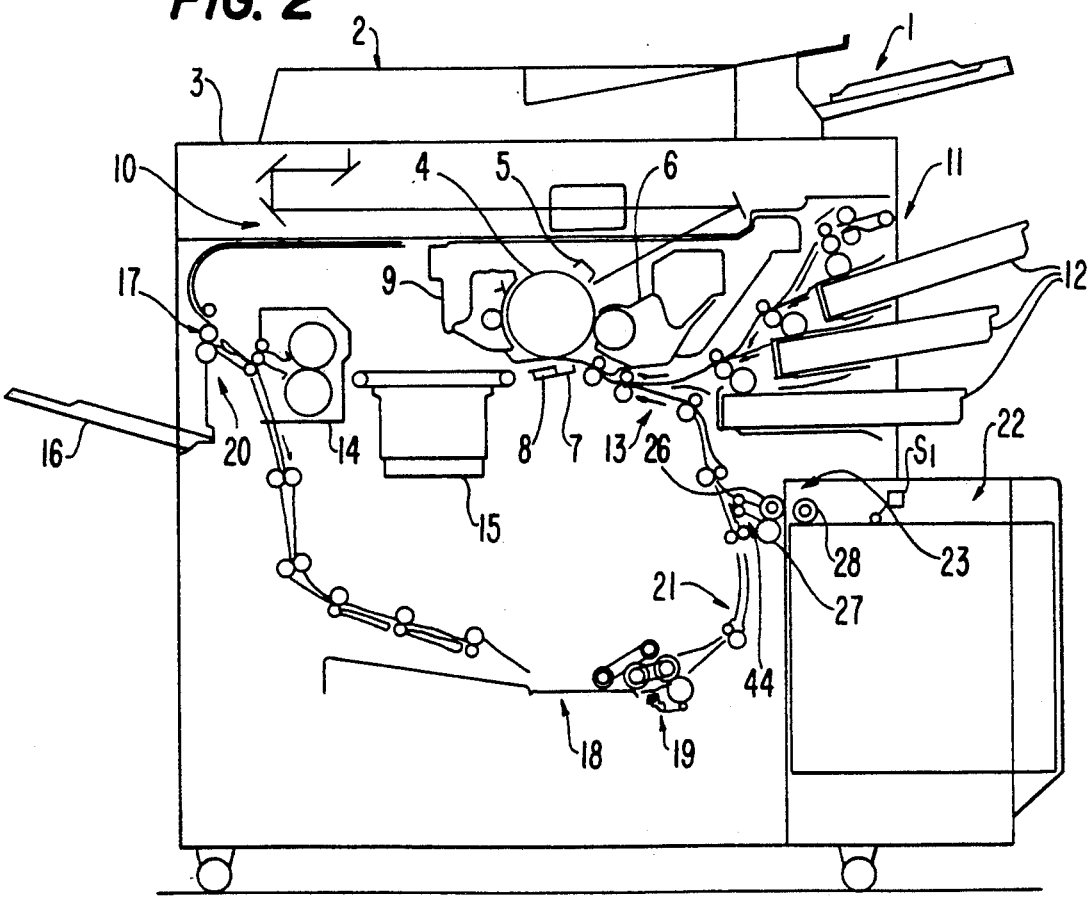
FIG. 2 is a longitudinal sectional view showing an electrophotographic copying machine as one example of an image forming apparatus.
Figure 3:
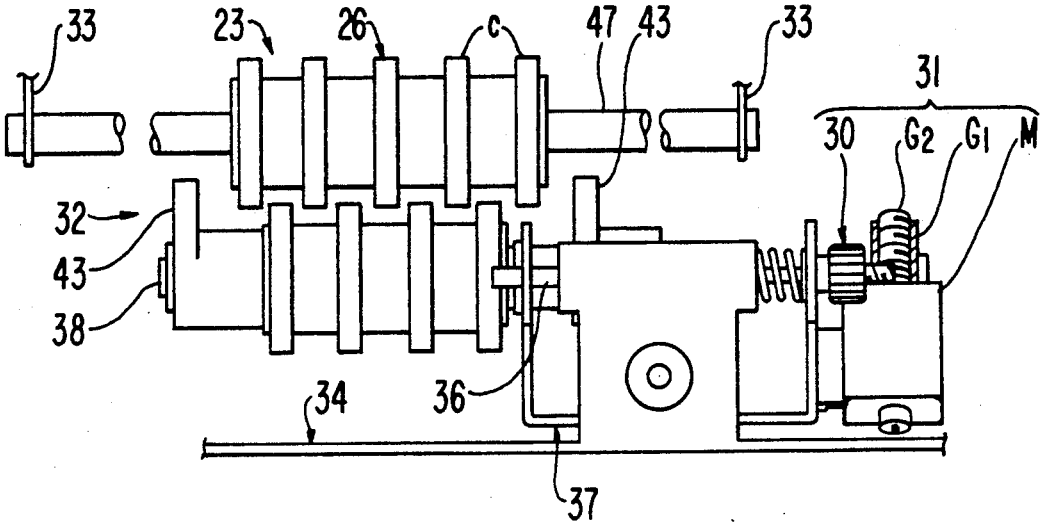
FIG. 3 is a front view showing the overlapped-transfer preventing paper supply device.
Figure 4:
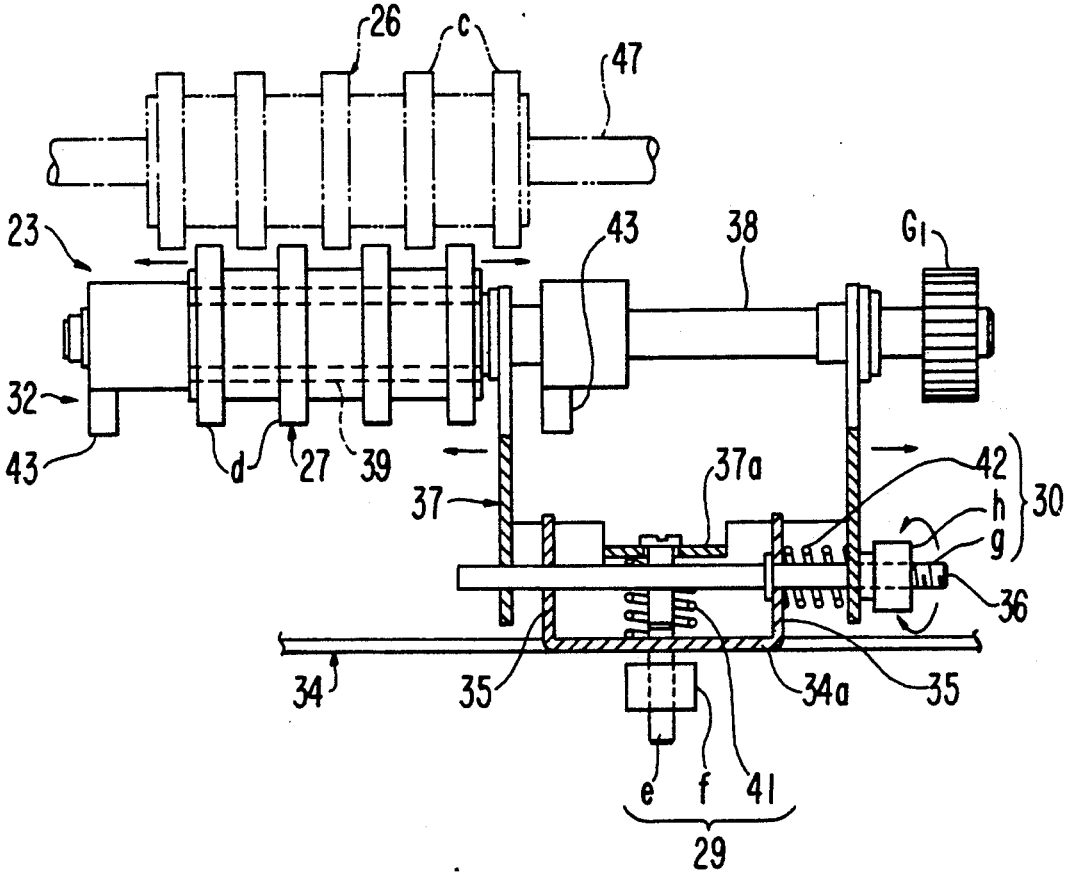
FIG. 4 is a plan view showing the overlapped-transfer preventing paper supply device with a rotary paper supply member shown by phantom lines.
Figure 5:
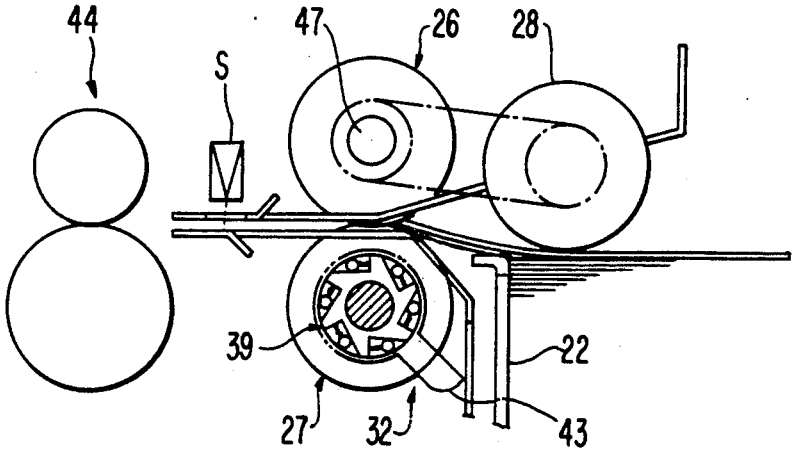
FIG. 5 is a side view showing the overlapped-transfer preventing paper supply device in which a section of a pad roller is shown.

Referring now to FIG. 2 schematically showing a copying machine as one example of an image forming apparatus, a manuscript-weight 2 provided with an automatic manuscript supply device 1 is provided in an upper portion of a body 3 of the copying machine. Body 3 is provided with a photoreceptor 4 and arranged therearound are a charging device 5, a developing device 6, a transfer device 7, and sheet-separating device 8 and a cleaning device 9. A movable type optical system exposure device 10 is arranged in an upper space of body 3, and a supplied-paper conveying device 13 conveys a sheet from a manual inserting position 11 or a paper supply cassette 12 to transfer device 7. A discharged-paper conveying device 15 conveys a transferred and separated sheet to a fixing device 14 and a pair of paper-discharging roll 17 for discharging the fixed sheet into a tray 16.

An intermediate tray 18 for stocking sheets that have been copied on one side is disposed in a lower portion of body 3. An overlapped-transfer preventing paper supply device 19 is disposed in a paper resupply portion of intermediate tray 18. A switchback mechanism 20 selectively discharges fixed sheets into intermediate tray 18. A conveying device 21 for use in a paper resupply operation extends from overlapped-transfer preventing paper supply device 19 to transfer device 7.

In addition, an elevator type paper supply deck 22 capable of housing therein a large volume of sheets is disposed below paper supply cassette 12, and an overlapped-transfer preventing paper supply device 23 supplies to conveying device 21 sheets housed in elevator type paper supply deck 22.

In use of the machine in a one side copy mode, an image is copied on one side of a sheet supplied from manual insertion portion 11, or cassette 12 or paper supply deck 22, and such copies sheet is discharged into the tray 16. Alternatively, in a both sides copy mode, an image is copied on one side of the sheet, the sheet then is supplied to intermediate tray 18, and then the sheet is supplied from tray 18 and the opposite side is copied, the sheet then being discharged into tray 16.

Figure 1:
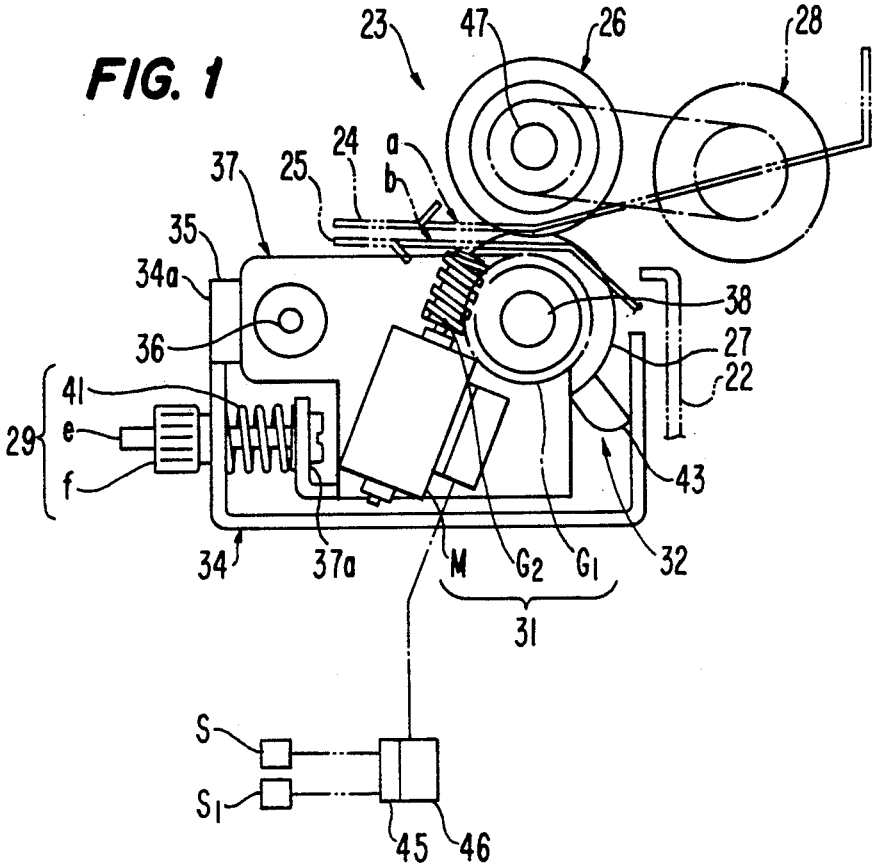
FIG. 1 is a side view showing an overlapped-transfer preventing paper supply device.

One specific construction of the overlapped-transfer preventing paper supply device of the invention now will be described with reference to device 23 adjacent paper supply deck 22. As shown in FIG. 1 and FIGS. 3 to 5, a pair of paper supply guide plates, that is an upper paper supply guide plate 24 and a lower paper supply guide plate 25, are provided with respective openings (a), (b) disposed in a paper supply portion of paper supply deck 22. A paper supply roller (one example of a rotary paper supply member) 26 formed of rubber is provided with a plurality of roller portions (c) which partly downwardly project through opening (a) of the upper paper supply guide plate 24. A pad roller (one example of an overlapped-transfer preventing member) 27 formed of rubber similarly is provided with a plurality of roller portions (d) which partly upwardly project through opening (b) of lower paper supply guide plate 25. Portions (c), (d) are axially staggered and the parts thereof that project through openings (a), (b) partially axially, as shown in FIG. 1. Thus, a pair of sheets may be drawn from deck 22 by upstream feeding roller 28 and are passed between rollers 26, 27 while being caused to be shaped widthwise in a zigzag configuration. A leading end of that sheet of the pair of sheets directed toward pad roller 27 will engage with and further supply of such sheet with pad roller 27 bill be stopped. Thus, only that sheet directed toward paper supply roller 26 will be supplied further.

A mechanism 29 adjusts the extend of overlap of said pad roller 27 relative to paper supply roller 26, i.e. the dimension of overlap between roller portions (c), (d) when rollers 26, 27 are arranged so as to be partially overlapped. A mechanism 30 adjusts the size of a gap between end faces of adjacent pairs of roller portions (c), (d). Driving means 31 rotates pad roller 27 in a direction opposite to the paper supply direction by a predetermined angle to restrain unbalanced abrasion of the overlapped transfer preventing roller 27. Sheet-returning means 32 returns a sheet located in the vicinity of the overlapped-transfer preventing portion of the sheet transfer path to paper supply deck 22 upon the generation of a signal detecting the lowering of paper deck 22 to supply sheets, by operation of driving means 31.

A rotary shaft 47 supporting paper supply roller 26 is pivoted on brackets 33 connected with the body 3 and is rotated in the paper supply direction at a predetermined time by means of drive means (not shown).

Pad roller 27. mechanism 29 for adjusting the extent of overlap, mechanism 30 for adjusting the size of the gap and driving means 31 are constructed in the following manner. That is to say, an upwardly extending plate member 34*a* of a base 34 fixedly placed on body 3 is provided with a pair of brackets 35 that are connected with respective flanges of a holding member 37 by a holding shaft 36 parallel to pad roller 27. Thus, holding member 37 is pivotally mounted on base 34 and is movable relative thereto axially of shaft 36. Holding member 37 has mounted thereon a shaft 38 that is reciprocally rotatable relative thereto and that is connectable to pad roller 27 through one-way transmission means 39 that allows rotation of roller 27 only in the direction opposite to the paper supply direction.

A screw shaft (e) passes through an upwardly extending plate member 37*a* holding member 37 and through plate member 34*a* of base 34, a nut member (f) is screwed onto screw shaft (e), and energizing means 41 formed of a compression coil spring is disposed between plate members 37*a*, 34*a*. Thus, the extent of overlap of the pad roller 27 relative to paper supply roller 26 may be adjusted by relative swinging movement holding member 37 around the holding shaft 36 due to the rotary operation of nut member (f).

In addition, holding shaft 36 is provided on one end thereof with a threaded portion (g), and a nut member (h) is screwed onto portion (g). Thus, holding member 37 may be adjusted in the direction of the axis of shaft 36 by an energizing means, e.g. spring, mounted between holding member 37 and one bracket 35. That is, adjustment of nut member (h) enables movement, along shaft 36 and relative to bracket 35, of holding member 37, and thereby shaft 38 and roller 27, so that the size of the gaps between roller portions (c) of paper supply roller 26 and roller portions (d) of pad roller 27 may be adjusted. This is achieved by the rotary operation of nut member (h) and the spring force of spring 42.

Shaft 38, has fixedly mounted thereon sheet-returning member 43 formed of a relatively hard material, for example a synthetic resin (polyacetal as one example). A worm wheel $G_1$ is fixed mounted on shaft 38, and a motor M provided with a worm shaft $G_2$ engaged with wheel $G_1$ is mounted on holding member 37 so that shaft 38 and thereby sheet-returning member 43 may be reciprocally rotated by regular and opposite rotations of motor M.

In addition, the dimension from the center of rotation of shaft 38 to a free outer end portion of sheet-returning member 43 is greater than the radius of pad roller 27, such outer end portion of member 43 is formed in the shape of a curved surface, and the length of such end portion is determined so that the end portion will not be brought into contact with shaft 47.

A reciprocally rotatable control member 46 is electrically connected with motor M so that when a sheet-returning signal, which is transmitted as a result of a signal indicative of lowering of paper supply deck 22 detected by a level switch $s_1$ (FIG. 2) as a function of the level of paper supply deck 22, is applied to control member 46, motor M may be reciprocally rotated by a determined number of times. Thereby, shaft 38 first is rotated in a direction opposite to the paper supply direction by one rotation and subsequently is rotated in the opposite direction. Rotation of motor M is transmitted to rotation of shaft 38 by means of worm shaft $G_2$ and worm wheel $G_1$. Shaft 38 is reciprocally rotated at every lowering or movement of paper supply deck 22, and pad roller 27 is rotated less than one rotation only in the direction opposite to the paper supply direction with the reciprocal rotation of shaft 38, whereby unbalanced abrasion of pad roller 27 can be prevented.

Figure 6:
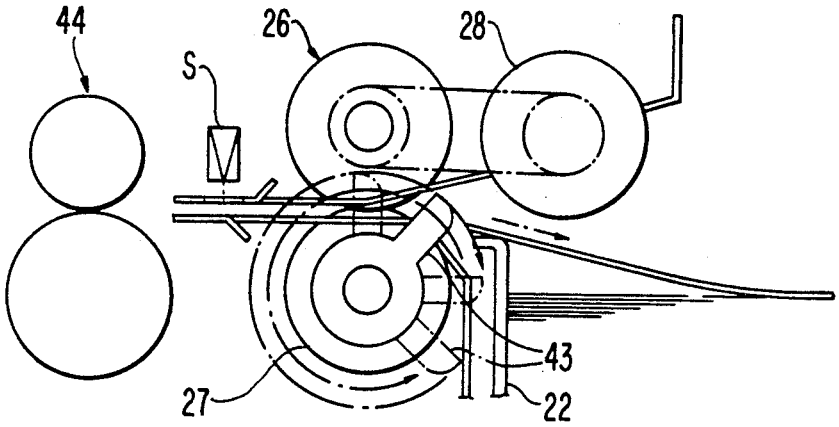
FIG. 6 is a side view illustrating the operation of the device.

As shown in FIG. 6, a sheet which has been prevented from being supplied overlapped with another sheet and, located in the vicinity of the overlapped-transfer preventing portion of the sheet transfer path can be returned to paper supply deck 22 by first rotating sheet-returning member 43 integrally with shaft 38 in the direction opposite to the paper supply direction, such that sheet-returning member 43 is moved to project upwardly through opening (b) at the downstream side of the overlapped-transfer preventing portion and then is moved to the upstream side of the overlapped-transfer preventing portion. As a result, the sheet which has been located in the vicinity of the overlapped-transfer preventing portion can be prevented from being smashed or damaged and jamming due to such sheet can be prevented when paper supply deck 22 is lowered to feed the next sheet and then paper supply deck 22 is raised to return to a determined position. Subsequently, sheet-returning member 43 is rotated to the initial position integrally with the shaft 38 for the next feeding of a sheet.

A sensor S for detecting the existence of a jam between the overlapped-transfer preventing portion and the pair of conveying rollers 44 is provided at a position immediately downstream side of the overlapped-transfer preventing portion.

Figure 7:
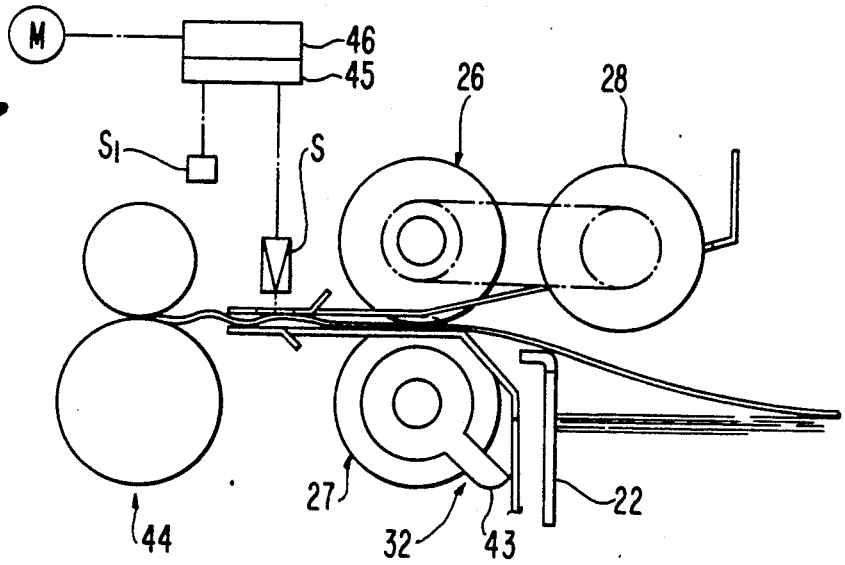
FIG. 7 is a side view showing a condition that a sheet is jammed in the vicinity of an overlapped-transfer preventing portion.

As shown in FIG. 7, if a sheet-returning signal is emitted when a sheet is jammed on the downstream side in the vicinity of the overlapped-transfer preventing portion and sheet-returning member 43 is moved from the downstream side to the upstream side of the overlapped-transfer portion so as to return a sheet which is located in the vicinity of the overlapped-transfer preventing portion to the paper supply deck 22, the jammed sheet is damaged by such movement of sheet-returning member 43 and thus is useless. In order to eliminate such inconvenience, when a signal indicative of a jam in the vicinity of the overlapped-transfer preventing portion is generated, motor M is not driven even when a sheet-returning signal is generated. That is to say, the above described jam-detecting signal is supplied to control member 46, and restraining means 45 prevents drive of motor M so that the return of the sheet to the paper supply deck 22 by sheet-returning member 43 will not be carried out and the sheet jammed in the vicinity of the overlapped-transfer preventing portion will not be damaged.

Figure 8:
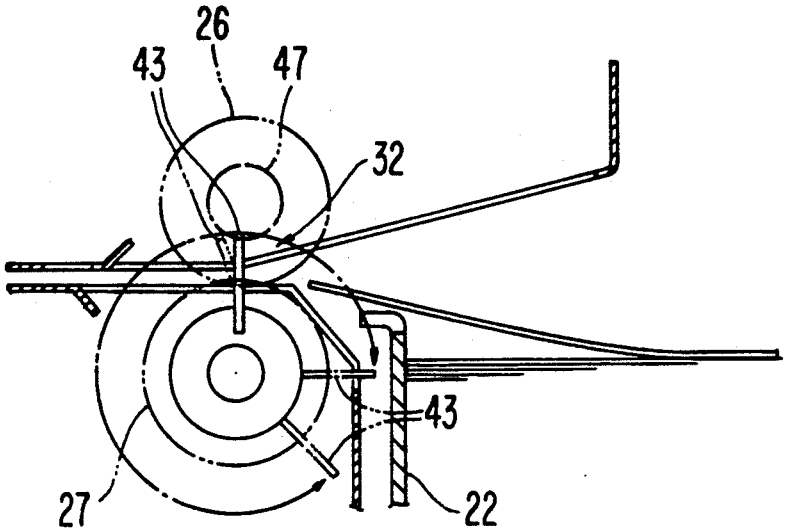
FIG. 8 is a side view showing principal parts of a sheet-returning member of a modified embodiment.

Although the free end portion of sheet-returning member 43 is prevented from being brought into contact with the shaft 47 in the above preferred embodiment, sheet-returning member 43 may be formed of thin elastically deformable materials so that the free end portion thereof can be brought into contact wit the shaft 47 when member 43 is moved from the downstream side of the upstream side of the overlapped-transfer preventing portion, as shown in FIG. 8.

Figure 9:
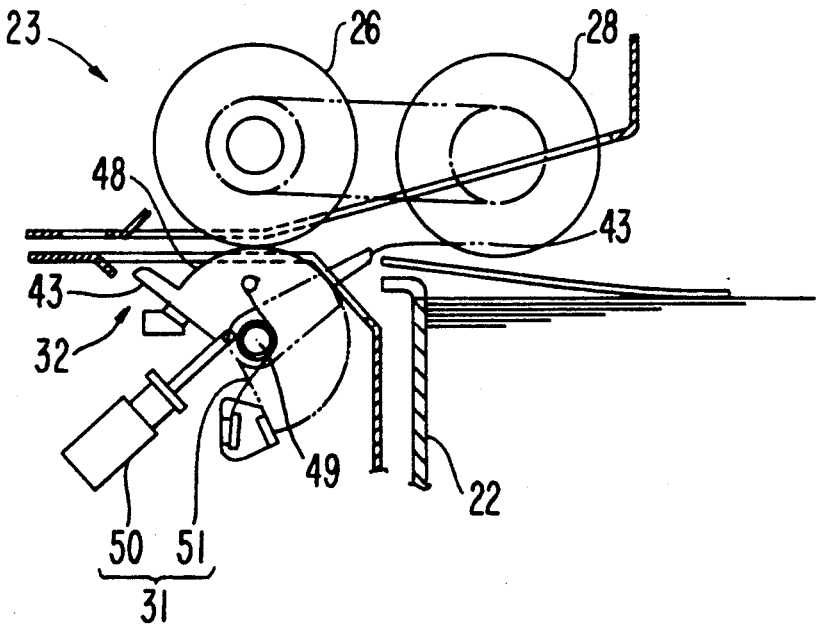
FIG. 9 is a side view showing an overlapped-transfer preventing paper supply device according to another preferred embodiment.

Another preferred embodiment of the overlapped-transfer preventing paper supply device 23 is shown in FIG. 9. In this preferred embodiment, a shaft 48 is provided with a reciprocally rotatable semi-circular friction pad 48 as the overlapped-transfer preventing member. A part of a circumferential surface of friction pad 49 is brought into contact with the paper supply roller 26, and the sheet-returning member 43 for returning sheet located in the vicinity of the overlapped-transfer preventing portion to the paper supply deck 22 is connected with a portion of friction pad 48 on a downstream side thereof in the paper supply direction. Driving means 31 includes a solenoid 50 and a returning spring 51. The solenoid 50 is excited by applying thereto a primary paper supply signal to rotate the sheet-returning member 43 in the paper supply direction against an energizing force of returning spring 51. If solenoid 50 is deenergized by a signal indicative of detection of the completion of an image-forming operation, both friction pad 48 and the sheet-returning member 43 are rotated in the direction opposite to the paper supply direction by the energizing force of said returning spring 51 to return a sheet located in the vicinity of the overlapped-transfer preventing portion to the paper supply deck 22.

In addition, although the sheet-running member 43 is adapted to be moved in the sheet-returning direction in combination with the rotation of pad roller 27 or friction pad 48 in the direction opposite to the paper supply direction in the above described preferred embodiments, sheet-returning member 43 may be moved independently or alone in the sheet-returning direction.

Further, although paper supply deck 22 is described above as a sheet source to be employed with the overlapped-transfer preventing paper supply device 23, manual insertion portion 11, the paper supply device of the paper cassette 12 or the intermediate tray 18 for use in paper resupply for copying both sheet sides could be used as the sheet source. In addition, the present invention can be employed with paper supply devices of various types of image-forming apparatus such as a printer and a facsimile machine, without being limited to a copying machine.

Furthermore, although the signal for moving sheet-returning member 43 in the sheet-returning direction is emitted as a result of a signal detecting lowering of the sheet source or paper supply device and the signal detecting completion of the image-forming operation in the above preferred embodiments, other modification also are possible. For example, the sheet-returning signal may be emitted as a function of a signal detecting feeding of a sheet from the sheet source or paper supply device.

As above described, according to the present invention, the sheet-returning member is adapted to move from the downstream side to the upstream side of the overlapped-transfer preventing portion as a function of a sheet-returning signal emitted as a result of a signal detecting lowering of the sheet source when the sheet source feeds a sheet, a signal detecting the completion of the image-forming operation, a signal initiating feeding of a sheet from the sheet source, or the like. Thus, a sheet which has been subjected to an overlapped-transfer preventing operation and located in the vicinity of the overlapped-transfer preventing portion can be returned to the sheet source, and a sheet located in the vicinity of the overlapped-transfer preventing portion can be prevented from being damaged. In addition, jamming due to such sheet surely can be prevented.

According to an additional feature of the invention, the operation of returning the above described sheet to the sheet-source is not initiated while a jam is present in the vicinity of the overlapped-transfer preventing portion. Thus, any sheet jammed in the vicinity of the overlapped-transfer preventing portion can be prevented from being damaged by the sheet-returning member.

What is claimed is:

1. In an overlapped-transfer prevent paper supply device for use in an image-forming apparatus wherein sheets of paper are supplied sequentially from a sheet source in a conveying direction along a transfer path, said device including along a portion of said transfer path means for preventing transfer of plural overlapped sheets, said preventing means comprising a rotary paper supply member rotatable in said conveying direction and an overlapped-transfer preventing member operable in cooperation with said supply member to prevent overlapped transfer of plural sheets, such that only a single sheet is transferred in said conveying direction beyond said portion of said transfer path and such that any other sheet supplied from the sheet source will be retained in said portion of said transfer path, the improvement comprising:

means for returning a sheet retained in said portion of said transfer path in a return direction toward the sheet source, said returning means comprising a returning member movable in said return direction from a downstream end of said portion of said transfer path to an upstream end thereof;

means for generating a sheet returning signal; and means for receiving a signal generated by said generating means and operative in response thereto for driving said returning member in said return direction.

2. The improvement claimed in claim 1, wherein said overlapped-transfer preventing member comprises a reciprocally rotatable shaft operable by said driving means, and a pad roller mounted in cooperative association with said rotary paper supply member and coupled to said shaft by a one-way transmission means to be rotatable by said shaft only in a direction opposite to said conveying direction, and said returning member is mounted on said shaft.

3. The improvement claimed in claim 1, wherein said overlapped-transfer prevent member comprises a reciprocally rotatable semi-circular friction member mounted in cooperative association with said rotary paper supply member, and said returning member is connected with said friction member.

4. The improvement claimed in claim 1, wherein said signal generating means is operable to generate said signal in response to a lowering movement of the sheet source.

5. The improvement claimed in claim 1, wherein said signal generating means is operable to generate said signal in response to completion of an image-forming operation of the image-forming apparatus.

6. The improvement claimed in claim 1, wherein said signal generating means is operable to generate said signal in response to feeding of a sheet from the sheet source.

7. The improvement claimed in claim 1, further comprising a sensor for detecting jamming of a sheet in said portion of said transfer path and for generating a signal representative thereof, and means operable in response to said signal of said sensor for preventing operation of said driving means and thereby to prevent movement of said returning member in said return direction.

8. The improvement claimed in claim 7, wherein said overlapped-transfer preventing member comprises a reciprocally rotatable shaft operable by said driving means, and a pad roller mounted in cooperative association with said rotary paper supply member and coupled to said shaft by a one-way transmission means to be rotatable by said shaft only in a direction opposite to said conveying direction, and said returning member is mounted on said shaft.

9. The improvement claimed in claim 7, wherein said overlapped-transfer preventing member comprises a reciprocally rotatable semi-circular friction member mounted in cooperative association with said rotary paper supply member, and said returning member is connected with said friction member.

10. The improvement claimed in claim 7, wherein said signal generating means is operable to generate said signal in response to a lowering movement of the sheet source.

11. The improvement claimed in claim 7, wherein said signal generating means is operable to generate said signal in response to completion of an image-forming operation of the image-forming apparatus.

12. The improvement claimed in claim 7, wherein said signal generating means is operable to generate said signal in response to feeding of a sheet from the sheet source.

* * * * *